US006155715A

United States Patent [19]

Lake et al.

[11] Patent Number: 6,155,715

[45] Date of Patent: Dec. 5, 2000

[54] LOCKING SECURITY DEVICE

[76] Inventors: Kevin Lake, 76 Woodward La., Basking Ridge, N.J. 07920; Paul J. Gammarano, 58 Kirshon Ave., Staten Island, N.Y. 10314-2706; William A. Reid, 560 W. 43rd St., New York, N.Y. 10036

[21] Appl. No.: 09/085,560

[22] Filed: May 26, 1998

[51] Int. Cl.[7] ..... B65D 33/14

[52] U.S. Cl. ..... 383/6; 190/101; 150/102; 70/64

[58] Field of Search ..... 383/6, 13, 15, 383/22, 23, 25, 26, 28, 97, 119; 224/563, 572; 190/101; 150/102, 134; 70/58, 63, 64

[56] References Cited

U.S. PATENT DOCUMENTS

| | | | |
|---|---|---|---|
| 76,297 | 4/1868 | Brosius | 150/134 |
| 338,846 | 3/1886 | Kimber | 190/101 |
| 934,230 | 9/1909 | Steinman | 70/63 X |
| 2,128,689 | 8/1938 | Bingham | 383/97 X |
| 2,159,279 | 5/1939 | Lipowsky et al. | 383/97 X |
| 2,310,627 | 2/1943 | Greene | 383/97 X |
| 3,422,498 | 1/1969 | Carlson | 150/134 X |
| 3,791,337 | 2/1974 | Schamblin | 383/22 X |
| 4,804,122 | 2/1989 | Knox | 150/102 X |
| 4,821,538 | 4/1989 | Gray | 70/58 X |
| 5,347,833 | 9/1994 | Branscum | 70/63 X |
| 5,545,590 | 8/1996 | Pfitzenmaier | 224/563 X |
| 5,624,071 | 4/1997 | Sosan | 70/63 X |
| 5,803,328 | 9/1998 | Nakahara | 224/414 X |

FOREIGN PATENT DOCUMENTS

| | | | |
|---|---|---|---|
| 2261813 | 6/1993 | United Kingdom | 150/102 |

*Primary Examiner*—Jes F. Pascua
*Attorney, Agent, or Firm*—Sofer & Haroun, LLP.

[57] ABSTRACT

A durable, water-resistant, locking pouch to safeguard package or parcel deliveries, with connected cable and anchor clamp. The cable provides a means to secure the pouch from under or behind a fixture such as a door. An anchor clamp, attached to the end of the cable furthest from the pouch, serves either as an anchor fastened to or placed behind a door, and prevents the device and its pouch with package/parcel contents from being dislodged.

3 Claims, 4 Drawing Sheets

LOCKING SECURITY DEVICE

BACKGROUND OF THE INVENTION

This invention relates to a locking security device for safeguarding delivered packages from theft, as well as a means of basic protection against foul weather conditions. Ever since package deliveries to residences and businesses have been made by carriers, the recipient has had to endure the inconvenience of non-delivery due to the recipient's absence. Virtually everyone has at some point experienced a notice of delivery failure with the need for a redelivery. Many of us have further experienced the inconvenient or costly delay of receiving a package because of the parcel carrier's signature requirement. Depending on the circumstances of the recipient, there may be no practical alternative for receiving a parcel without redelivery by the carrier or the carrier's requirement to pick it up at the central distribution point.

The purpose of the subject device is to provide a physical means of securing a package or parcel delivery at one's own doorstep. For example, where packages must be left in an open or exposed residential porch or vestibule area, the device facilitates a locking mechanism to help prevent removal or opening and pilferage of a package's contents. While there is no totally theft-proof device, the device of the invention serves as a potential deterrent to pilfered and tampered package deliveries.

SUMMARY OF THE INVENTION

This invention is directed to a locking pouch which is comprised of a tamper-resistant and water-resistant material, capable of being folded or rolled up, connected to a securing cable with an anchor clamp to serve as an anchoring or stopper mechanism at the distal end (furthest from the pouch) of the cable. The object of the subject invention is to provide a means of safeguarding parcels or packages from casual theft or pilferage after destination delivery has been made.

Inside access to this protective reinforced pouch is limited to those who are authorized. Authorized access (i.e. opening the pouch of the device after it has been locked) is limited by means of a key lock.

DETAILED DESCRIPTION OF THE INVENTION

Figure 1:
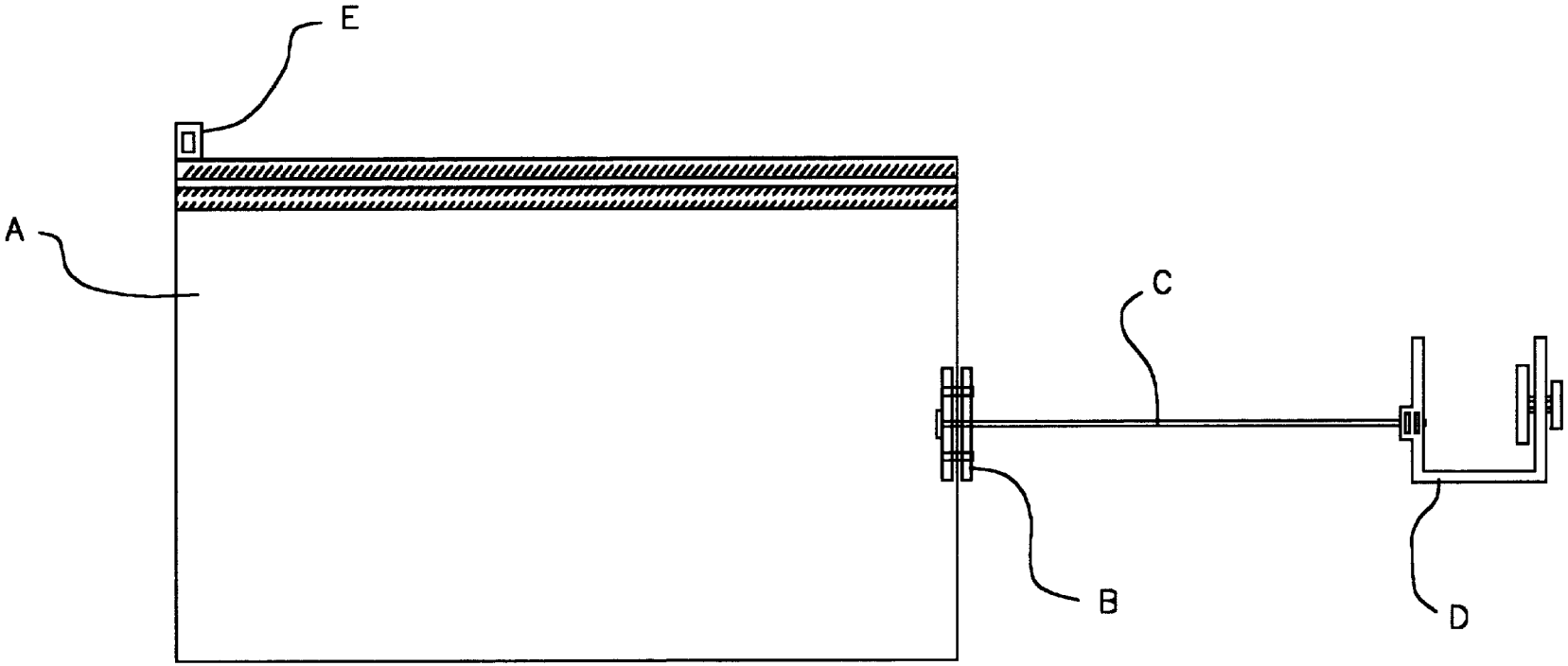
FIG. 1 is a side view of the device of the invention, showing pouch A, fastener B, security cable C, and anchor clamp D.

Referring to FIG. 1, as a package/parcel securing device is used to provide a safe, theft-resistant and water-resistant means of package/parcel storage until the recipient can remove the package/parcel. Pouch A opens and closes via a zipper with a lock E (commercially available as prior art). The securing cable C of the securing device is either clamped via hand-tightening/hand-adjusting to the underside of the door with anchor clamp D or passed under the doorway, whereby it is used as a stopper. Pouch A is placed outside the door.

Figure 2:
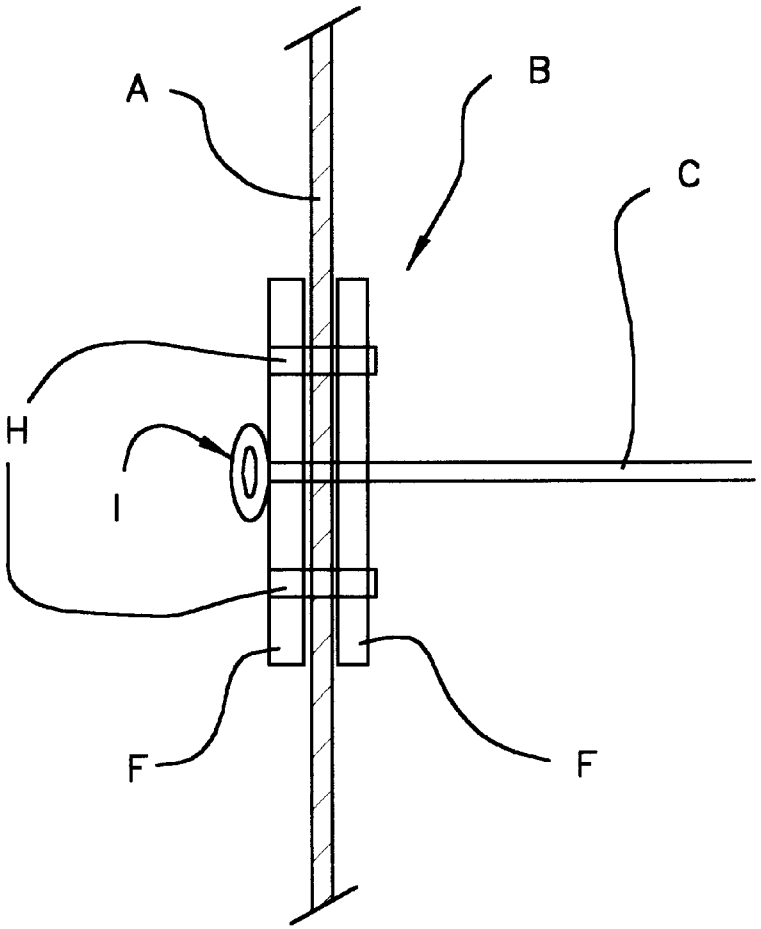
FIG. 2 is a front view of fastener B and side view of fastener B fastened to pouch A, and security cable C.
Figure 2:
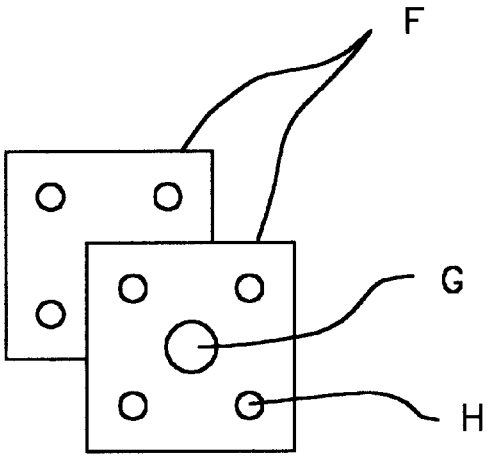

Referring to FIG. 2, pouch A of the securing device has attached fastener B, which consists of a pair of small, flat plates F with pre-cut center holes G. Plates F are fastened together with rivets H around the material of pouch A. Fastener B connects pouch A by "sandwiching" the material of pouch A between each plate F. The fastener B attaches a thin securing cable C made of a pliable and durable material. Cable C passes through pre-cut holes G in fastener B and pouch A. Loop I at end of cable C is larger than the diameter of pre cut center holes G.

Figure 3:
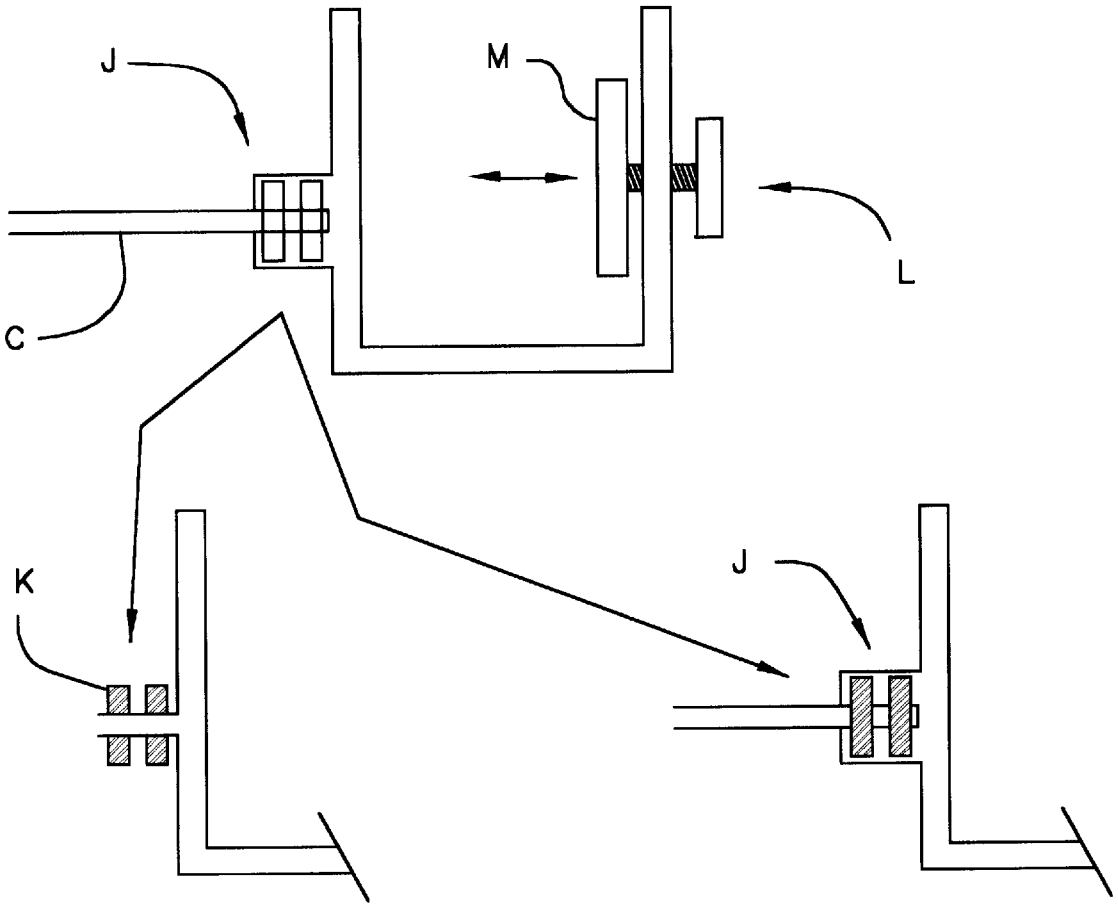
FIG. 3 is a side view of anchor clamp D crimped to security cable C, and also shows uncrimped and crimped metal flaps of anchor clamp D, which also includes a threaded screw on one of its two parallel sides to enable the fastening of anchor clamp D to doors of varying thicknesses. Tightening and loosening of the screw can be made with one's bare hand.

Referring to FIG. 3, the subject device has an anchor clamp D that is connected by crimping to the end of securing cable C at the point of the cable furthest from pouch A. Said anchor clamp D is U-shaped and made of a durable, rupture-resistant material, with a die-cast flap-extended crimping point J. Securing cable C is crimped to anchor clamp D by firmly pressed flaps K over the end of securing cable C. When anchor clamp D is in use, the closure of the door to which it is connected is not impeded.

A threaded hole on the parallel side of anchor clamp D furthest from the flap-extended crimping point J holds an adjustable wing-screw L.

Said anchor clamp D is large enough to prevent cable C from being pulled or otherwise forced through the door where the cable has been placed.

Figure 4:
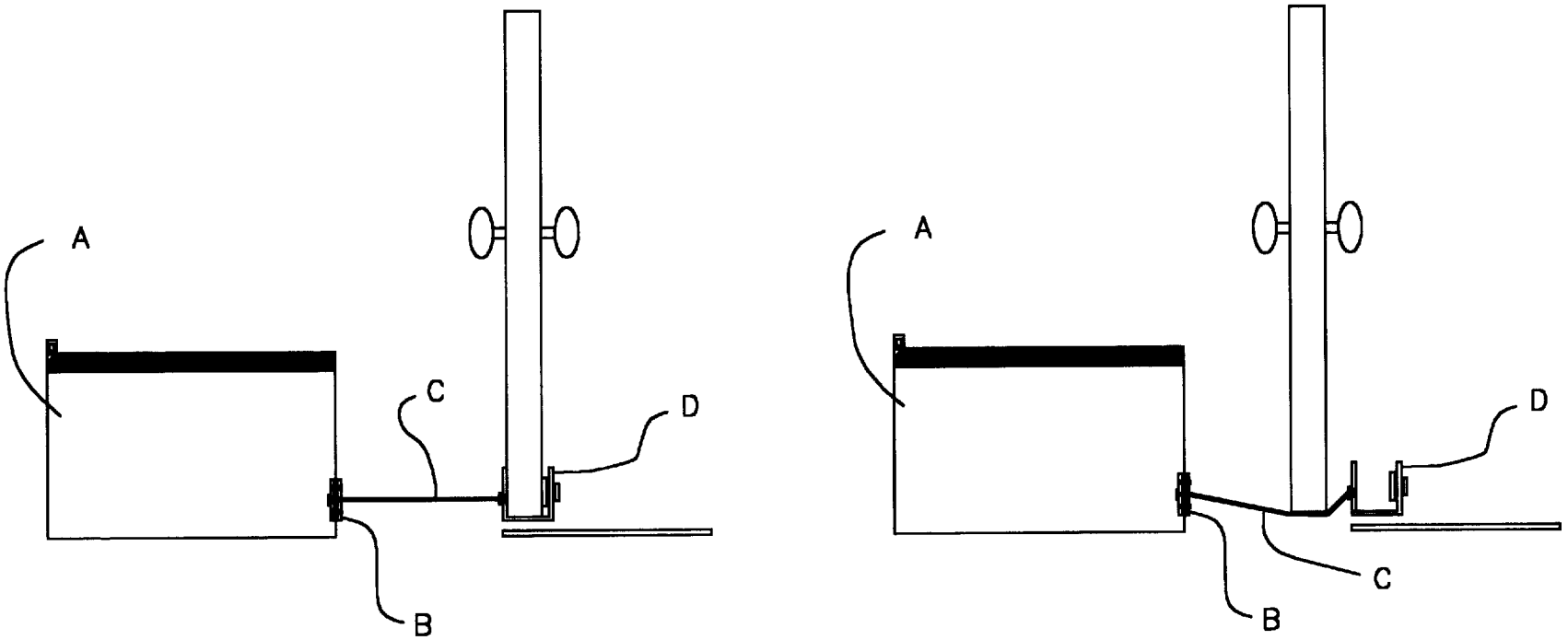
FIG. 4 is a side view of anchor clamp D and connected security cable C. In the first embodiment, said anchor clamp D is fastened to the underside of the door. In an alternate embodiment, said security cable C is passed under the door, with unfastened anchor clamp D placed inside the doorway.

Referring to FIG. 4, anchor clamp D can, as one option be fastened to the underside of the door, and with hand-tightening and hand-adjusting of the screw L, make attached adjustment plate M snug to the inside of the door. Dislodgment of pouch A exposed outside the door is prevented by unfastened anchor clamp D as a stopper in contact with the inner side of the door.

As another option, the security cable C can be run underneath the door to the inside of the doorway, with unfastened anchor clamp D inside the doorway. Dislodgment of pouch A exposed outside the door is prevented.

The securing device is reusable on a repeated basis after the contents of pouch A have been removed.

In use, locking pouch A is placed outside the door. Cable C is attached by anchor clamp D to the bottom of the door, or placed inside of the doorway as a non-fixed anchor. The anchor clamp D is limited in movement to areas behind the door only when placed in use. After the door is shut, anchor clamp D and cable C prevent pouch A from being taken away from the door. An adjustable screw on anchor clamp D can secure anchor clamp D and cable C to the door to prevent undesired movement of cable C. Packages/parcels or other objects placed within pouch A are tamper-resistant, water-resistant, and theft-resistant.

While there has been shown and described a preferred embodiment of the security device of this invention, it is understood that changes in structure, materials, sizes, and shapes can be made by those skilled in the art without departing from the invention. The invention is defined in the claims herein.

What is claimed is:

1. A locking security device adapted to be secured to a door, said device comprising:

a pouch capable of enveloping packages, parcels or other objects, a connecting cable extension connecting said pouch with an anchor clamp, said anchor clamp being operable to engage the door to secure the pouch from being removed from a position adjacent the door, wherein said pouch has two outer surfaces, the extension comprising a cable connected by plated fasteners layered flat on the outer two surfaces, sandwiched in a "plate-pouch-plate" assembly, through which the cable passes.

2. A locking security device adapted to be secured to a door, said device comprising:

a pouch capable of enveloping packages, parcels or other objects, a connecting cable extension connecting said pouch with an anchor clamp, said anchor clamp being operable to engage the door to secure the pouch from being removed from a position adjacent the door, wherein said connecting cable is crimped to said anchor clamp at an end thereof distal from pouch which serves as an anchor for the cable extension connected to said pouch, said anchor clamp being made of durable material and being large enough to prevent the cable extension from being pulled or otherwise forced away and apart from the door.

3. A locking security device for securing a parcel adjacent a door in a doorway, said door and doorway defining a space therebetween, said device comprising:

a pouch configured to receive therein the parcel, said pouch being formed of flexible fabric and having a sealing and locking structure such that the pouch can be securely closed around the parcel so that the parcel cannot be removed without opening the sealing and locking structure;

a flexible connecting extension having a first portion secured to said pouch and a second portion spaced from the pouch;

an anchor secured to the second portion of the connecting extension, said anchor being configured such that when the pouch is drawn away from the door, the anchor engages the door and prevents said withdrawal, the anchor including a clamp which is clampingly secured in engagement with the door, and which can only be released from a side of the door opposite to the side adjacent which the pouch is located, the clamp including a first portion connected with the connecting extension and engaging the side of the door adjacent the pouch, a second portion connected with the first portion and extending therefrom through the space between the door and doorway, and a third portion connected with the second portion and engaging the opposite side of the door, the door being clamped between the first and third portions; and said connecting extension including a connecting cable that is crimped to a crimping structure on the first portion of the clamp.

* * * * *